United States Patent [19]

Osterloh et al.

[11] 4,102,674

[45] Jul. 25, 1978

[54] METHOD FOR HARDENING IRON ORE PELLETS

[75] Inventors: Kurt Osterloh; Karl Peter; Paul Gernhardt, all of Bochum; Wolfgang Grams, Herne; Christian Hundeshagen, Bochum; Wilhelm Danguillier, Bochum; Siegfried Pohl, Bochum, all of Fed. Rep. of Germany

[73] Assignee: Dr. C. Otto & Comp. G.m.b.H., Bochum, Fed. Rep. of Germany

[21] Appl. No.: 766,262

[22] Filed: Feb. 7, 1977

[30] Foreign Application Priority Data

Feb. 27, 1976 [DE] Fed. Rep. of Germany ..... 2608003

[51] Int. Cl.[2] ..... C22B 1/14

[52] U.S. Cl. ..... 75/3; 48/197 R; 75/5; 266/140; 266/186

[58] Field of Search ..... 75/3, 4, 5, 34, 35, 75/36, 91; 48/DIG. 2, 197 R; 266/186, 140

[56] References Cited

U.S. PATENT DOCUMENTS

| | | | |
|---|---|---|---|
| 2,934,476 | 4/1960 | Zvejnieks | 48/197 R |
| 3,853,538 | 12/1974 | Nemeth | 75/35 |
| 3,870,480 | 3/1975 | Moss | 48/197 R |
| 4,013,427 | 3/1977 | Gernhardt et al. | 48/92 |

OTHER PUBLICATIONS

Maccormac, M., et al.; "The Gasification of Coal in an Experimental Rummel Double-Shaft Slag Bath Generator", IGE Journal (5/65) pp. 385–399.

Domann, F.; "Stand des Schlackenbadgenerators"; *Internationale Zeitschrift fur Gaswarme,* vol. 14 (1965) pp. 325–330.

*Primary Examiner*—L. Dewayne Rutledge
*Assistant Examiner*—Michael L. Lewis
*Attorney, Agent, or Firm*—Thomas H. Murray

[57] ABSTRACT

Iron ore pellets on a grid in a treatment chamber are hardened by contact with a heat treated, low calorific gas. The gas is generated in the gasification chamber of a slag bath generator. The generator receives a gasification agent and solid fuel that preferably further includes sulfur-binding materials, such as dolomite for generating a stream of low calorific gas. Inclined water-cooled pipes at the upper end of the slag bath generator extract liquid slag from the gas stream. The slag drips from the pipes into the slag bath generator. A mixing chamber receives the gas at a temperature of about 1450° C passed beyond the inclined water-cooled pipes together with an air supply for heat treating the gas to a temperature of about 1100° C. The heat treated gas is then passed into the treatment chamber for hardening the iron ore pellets contained therein.

7 Claims, 1 Drawing Figure

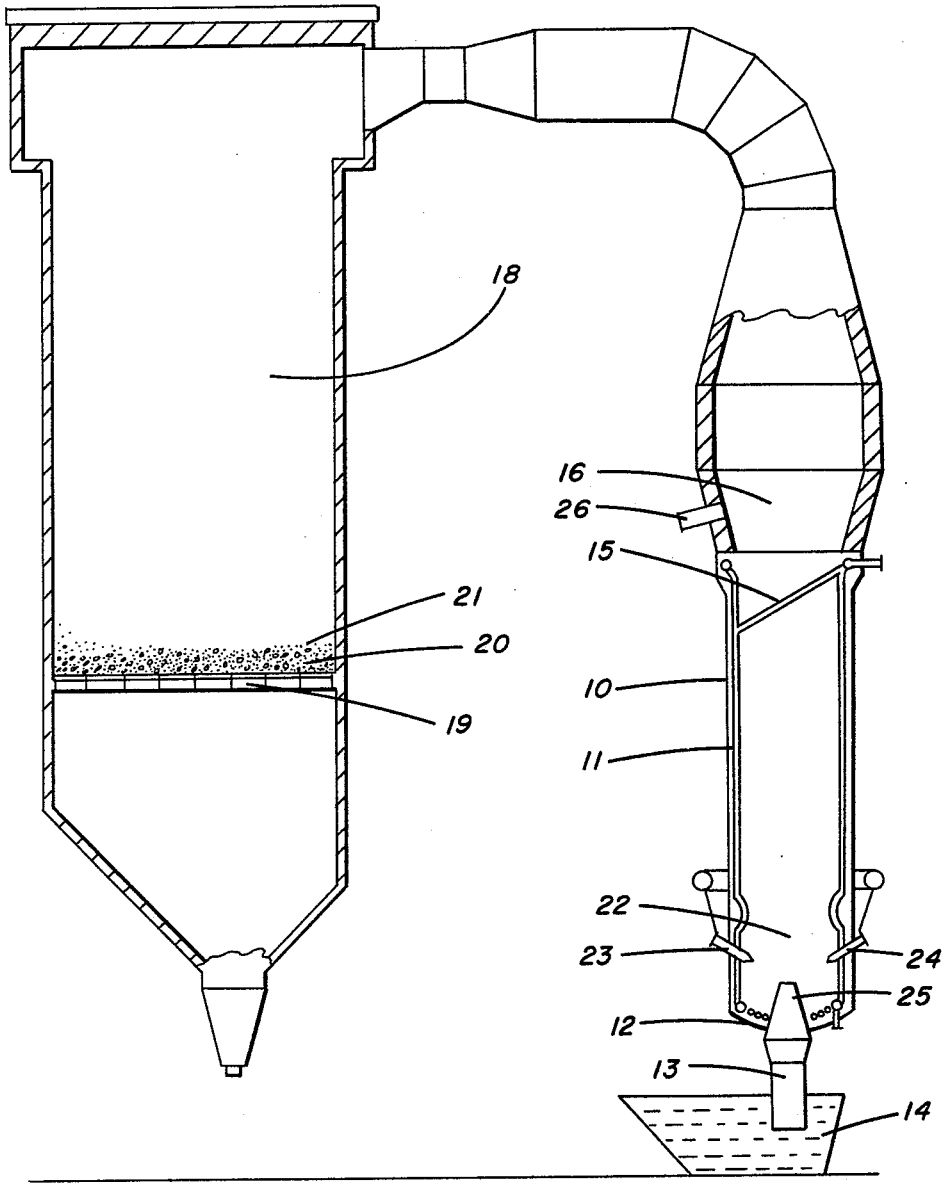
18
16
26
15
21
20
10
19
11
22
23
24
25
12
13
14

METHOD FOR HARDENING IRON ORE PELLETS

BACKGROUND OF THE INVENTION

This invention relates to an apparatus and method for producing a gas for drying and hardening iron ore pellets; and more specifically to the construction and operation of a slag bath generator to generate low calorific gas which is further processed in a manner which is suitable for the treatment of iron ore pellets in a treating chamber located downstream of the slag bath generator.

A gas of the type which is suitable for drying and hardening iron ore pellets must have a sufficiently high calorific content and a sufficiently high temperature so as to avoid a detrimental effect on iron ore pellets. The gas should be free of constituents which are detrimental to the pellets. Generally, flue gas is suitably heated and used for this purpose. The starting materials to produce the flue gas are combustible gases or liquid fuels. See, for example, an article by Melvin J. Greaves, *Iron and Steel*, April 1973, pages 171–173.

SUMMARY OF THE INVENTION

It is an object of the present invention to provide an apparatus and process to produce a suitable gas having a sufficiently high temperature in an economically-advantageous manner from solid fuels, particularly coal for hardening iron ore pellets.

It is still another object of the present invention to provide an apparatus and process for producing a gas which is suitable for drying and hardening iron ore pellets while at the same time such pellets are not detrimentally affected by materials contained in the solid fuel, particularly coal from which the gas is produced.

The gas required for drying and hardening iron ore pellets can be produced in a generator adapted to operate at an elevated temperature while permitting the non-combustible constituents of the coal to be removed from the reactor in the form of a molten slag. It has been found that a lean gas having a relatively high temperature, a low-dust content and a low content of materials which may interfere with the iron ore pellets can be produced with a relatively ease of effort in a slag bath generator under specified operating conditions.

In accordance with the present invention, there is provided apparatus for hardening iron ore pellets by contact with a generated gas, the apparatus including the combination of a slag bath generator receiving a gasification agent and solid fuel for producing low calorific gas and liquid slag, a slag-collecting grid to extract slag while passing the low calorific gas generated by the slag bath generator, a mixing chamber receiving the low calorific gas passed beyond the slag-collecting grid, the mixing chamber including means to supply air for heat treating the low calorific gas in the mixing chamber and a treatment chamber adapted to contain iron ore pellets to undergo hardening by contact with the heat treated, low calorific gas passed from the mixing chamber.

In another aspect of the present invention, there is provided a process for hardening iron ore pellets including the steps of generating low calorific gas in the gasification chamber of a slag bath generator, extracting liquid slag from the stream of low calorific gas produced by the slag bath generator after passing from the gasification chamber, thereafter heat treating the low calorific gas by admixture with air in a mixing chamber, and contacting iron ore pellets in a treatment chamber with the heat treated, low calorific gas to harden the iron ore pellets.

Thus, according to the present invention the apparatus for producing a gas suitable for drying and hardening iron ore pellets comprises a generator which operates with liquid slag and from which lean gas generated therein is extracted via a slag-collecting grid into a mixing chamber where the gas is heat conditioned by admixture with air preparatory to feeding the heat conditioned gas into a treatment chamber containing the pellets to undergo drying and hardening.

The slag-collecting grid is advantageously formed by water-cooled tubes which are arranged in such a manner that slag, deposited on the tubes, drips into the slag bath arranged within the bottom of the slag bath generator.

A description of a slag bath generator is found in an article by F. Domann entitled "Stand des Schlackenbadgenerators", published in "Internationale Zeitschrift fur Gaswarme", Volume 14, No. 8, 1965, pages 325–330. A slag-collecting grid as used in a Rummel double-shaft slag bath generator is described by M. Maccormac et al in I.G.E. Journal, May 1965, pages 385–399.

It is advantageous to add sulfur-binding substances to the fuel which is processed in the slag bath generator to insure that the sulfur content of the coal fed into the slag bath generator does not lead to an undesirable sulfur content of the gas generated therein. The sulfur-binding substances may, if desired, be of the type containing calcium oxide or substances which form calcium oxide when heated, for example, dolomite.

The gasification media which is fed into the slag bath generator can be, for example, preheated air or oxygen-enriched air. When atmospheric air is employed as the gasification medium, then the gas produced in the gasification chamber has a low calorific value. It is also desirable that the gas is produced in a manner so that the gas does not have a high nitrogen oxide content which can be achieved by operating the slag bath generator so as to readily carry out the gasification process. The generator may, if desired, be operated at an elevated pressure of, for example, between 3 and 6 bar. It has been found that a gas of 9400 kH/kmol (moist) [100 kcal/$m^3_{NTP}$ (moist)] can be produced when air is used as the gasification medium.

If a residual calorific value remains in the gas after being passed through the mixing chamber, the gas will be subjected to afterburning under oxidizing conditions when the pellets are hardened.

These features and advantages of the present invention as well as others will be more readily understood when the following description is read in light of the accompanying drawing wherein there is illustrated a preferred form of the apparatus according to the present invention for hardening and drying iron ore pellets as well as the use of such apparatus to carry out the process according to the present invention.

As illustrated in the drawing, a slag bath generator includes a shell 10 which is protected against high temperatures developed in the gasification chamber 22 by vertically-arranged cooling pipes 11 which are arranged side-by-side to form a thermal protective liner. Fine-grain fuel, e.g., coal, and a gasification medium, i.e., air, are blown or injected into the gasification chamber 22 by means of nozzles 23 and 24. In the bottom 12 of the slag bath generator, there is a centrallylocated and upwardly-extending slag discharge tube 25. Liquid slag collects in the trough which is formed around the lower portion of the tube 25. Slag is discharged from the inner edge of the trough through a pipe 13 into a water bath 14.

Fine-grain fuel and gasification medium introduced by nozzles 23 and 24 undergo gasification in chamber 22. The fine-grain fuel and gasification medium are suitably metered to produce a lean gas which is discharged through a slag-collecting grid formed by water-cooled tubes 15 after which the gas passes into dome 16 of the generator. As shown in the drawing, the water-cooled tubes 15 extend in an inclined manner so as to traverse the stream of gas discharged upwardly from the gasification chamber 22. Air for the heat treatment of the gas produced in the gasification chamber is supplied through duct 26 into the dome 16. The heat treated gas passes from dome 16 through a conduit into a treatment chamber 18 wherein pellets, e.g., iron ore, are deposited on suitable devices, for example, a carriage 19 or on a grid. To protect the grids of the carriages, it is a conventional practice to first deposit pellets 20 which have already been hardened on the grid to form a bottom layer on the carriage. Green (untreated) pellets 21 form an overlying layer which are subjected to treatment, i.e., hardening and drying by the gas which is introduced into the treatment chamber 18.

EXAMPLE

The following example of the apparatus already described details the process using the apparatus according to the present invention. American hard lignite containing 13% moisture, 10% ash and a heat unit value of 22600 kJ/kg [5400 kcal/kg] is introduced at a rate of 2740 kg/h by nozzles 23 and 24 into the generator together with 19900 kg of air, saturated at 20° C. The gas which is produced in the gasification chamber of the slag bath generator is laden with slag and slag coke. The gas passes upwardly through the slag-collecting grid 15 where the slag accumulates on the inclined pipes. The slag is returned to the generator by dropping into the slag bath at the bottom thereof from where the slag is discharged through the discharge tube 25 into the water bath 14. Beyond the slag-collecting grid 15, the gases have a temperature of approximately 1450° C at which temperature, the gases enter dome 16 of the generator. In the generator, the gases are heat treated to a temperature of 1100° C. This is accomplished by feeding 9500 kg of cold air through duct 26 into the dome. The heat treated gases then pass from dome 16 into the treatment chamber 18 wherein pellets to undergo hardening and sintering are located. The pellets are arranged as previously described on the grid 19.

The gases entering the treatment chamber 18 have the following specifications:

TABLE

| | | | | | |
|---|---|---|---|---|---|
| Quantity | = 32500 kg | | | (including water vapor) | |
| | = 1109 kmol | | | (including water vapor) | |
| [Density | = 1.3 kg/m$^3_{NPT}$ | | | (moist)] | |
| cpm | = 1.22 kJ/kgK | | | | |
| Pressure | = 760 mm WG | | | | |
| Gas analysis (inclusive of $H_2O$): | | | | | |
| $CO_2$ | $N_2$ | $H_2O$ | $O_2$ | $SO_2$ | NO |
| 11.2 | 73 | 9.5 | 6.2 | 0.1 Vol.% | 40 ppm v |
| Dust Load: 4.2 g dust/kg of gas | | | | | |
| C content of the dust: 57%. | | | | | |

If it is assumed that the entrained dust by the gas entering the treatment chamber 18 is completely separated during the treatment of the pellets, then there is an increase in the proportion of gangue in the pellets. This increase of gangue is calculated to be at a maximum of approximately 0.3%. Such a gangue increase is assumed to be tolerable given the conventional gangue proportion of 10%. Based on an assumption of a mximum heat consumption of $10^6$ kJ per ton of pellets, the thermal efficiency will be 70% with respect to the treatment gas and the fuel. The foregoing Example has reference to magnetitic concentrates; however corresponding values are obtained when using other kinds of coal.

The gases after treating at a higher temperature are necessary for haematitic pellets. The increased temperature can be readily obtained by employing other fuels and by changing the operation of the slag bath generator as well as by employing a different degree of heat treatment in the mixing chamber 16.

For example, the softening point of the slag produced in the slag bath generator can be increased by additives so that the gas used for the heat treating process is extracted from the mixing chamber 16 at a temperature of 1300° C. As a result of the increased slag melting point, a proportion of the slag-bearing solids which are carried along with the gas into the mixing chamber have already solidified at this point. Thus, the walls of the pipelines which conduct the gas will not become coated with slag. As discussed hereinbefore, to insure that the sulfur contained in the coal which is fed into the gasification chamber does not yield an undesirable sulfur content in the gas generated therein, sulfur-binding substances are added to the fuel before it is fed into the gasification chamber. These substances are those containing calcium oxide or substances which form calcium oxide when subjected to heat. An example of such a substance is dolomite.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. A process for hardening iron ore pellets, said process including the steps of:

generating low calorific gas in a gasification chamber of a slag bath generator, extracting liquid slag from the stream of low calorific gas produced by the slag bath generator after passing from said gasification chamber, thereafter heat treating the low calorific gas by admixture with air in a mixing chamber, and contacting iron ore pellets in a treatment chamber with the heat treated, low calorific gas to harden the iron ore pellets.

2. The process according to claim 1 wherein said step of generating low calorific gas includes feeding fine-grain fuel and a gasification agent into the gasification chamber of the slag bath generator, and adding sulfur-binding materials to said fuel for feeding therewith into the slag bath generator.

3. The process according to claim 2 wherein said sulfur-binding material includes dolomite.

4. The process according to claim 1 wherein said step of generating low calorific gas includes maintaining an elevated pressure within the gasification chamber of said slag bath generator.

5. The process according to claim 1 wherein said step of generating low calorific gas includes maintaining an elevated pressure within said gasification chamber while concurrently feeding a gasification agent and fine-grain fuel which are admixed with a sulfur-binding material into the gasification chamber for processing by the slag bath generator.

6. The process according to claim 1 wherein said step of extracting liquid slag includes contacting the stream of low calorific gas with the surface of water-cooled pipes.

7. The process according to claim 6 wherein said step of extracting liquid slag further includes arranging said water-cooled pipes in an inclined manner in the slag bath generator to traverse the stream of gas passing from the gasification chamber thereof.

* * * * *